United States Patent [19]

Miyao

[11] 4,109,631

[45] Aug. 29, 1978

[54] IGNITION SYSTEMS OF INTERNAL COMBUSTION ENGINES

[75] Inventor: Hiroyasu Miyao, Hamamatsu, Japan

[73] Assignee: Yamaha Hatsudoki Kabushiki Kaisha, Iwata, Japan

[21] Appl. No.: 732,041

[22] Filed: Oct. 13, 1976

[30] Foreign Application Priority Data

Oct. 17, 1975 [JP] Japan ..... 50-141520[U]
Jun. 23, 1976 [JP] Japan ..... 51-74683

[51] Int. Cl.[2] ..... F02P 1/00
[52] U.S. Cl. ..... 123/148 CA
[58] Field of Search ..... 123/148 CA, 148 E, 148 AC, 123/148 DC, 148 F, 149 D, 149 C

[56] References Cited

U.S. PATENT DOCUMENTS

| | | | |
|---|---|---|---|
| 3,169,212 | 2/1965 | Walters | 123/148 CA |
| 3,259,799 | 7/1966 | Nilssen | 123/148 DC |
| 3,759,237 | 9/1973 | Shino et al. | 123/148 E |
| 3,886,923 | 6/1975 | Gerry | 123/148 AC |
| 3,896,780 | 7/1975 | Kondo | 123/148 E |
| 3,938,490 | 2/1976 | Snyder et al. | 123/148 E |
| 3,993,035 | 11/1976 | Gerry | 123/148 E |

*Primary Examiner*—Charles J. Myhre
*Assistant Examiner*—R. A. Nelli
*Attorney, Agent, or Firm*—Charles E. Pfund

[57] ABSTRACT

A reactor and the primary winding of an ignition transformer are connected in series across a source of direct current, the secondary winding of the ignition transformer is connected across an ignition plug and an interrupter is connected in parallel with the primary winding.

9 Claims, 16 Drawing Figures

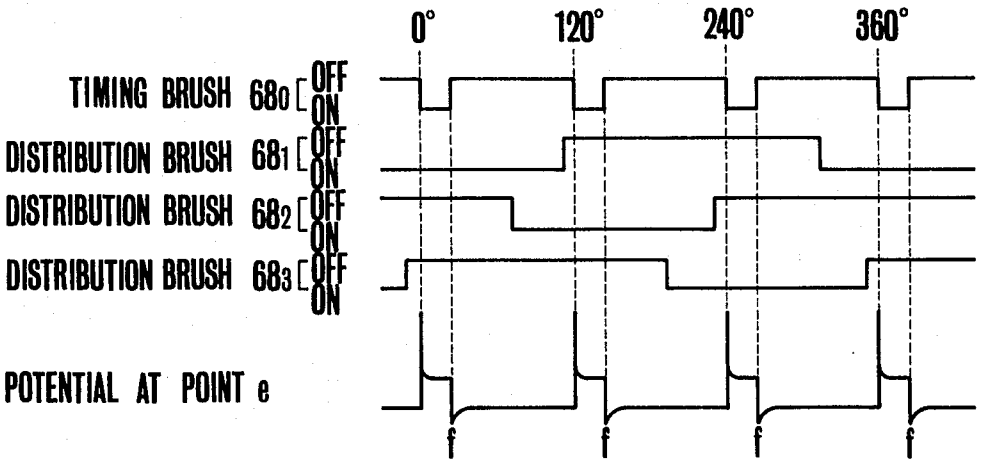
FIG.6A
FIG.6B
FIG.6C
FIG.6D
FIG.6E
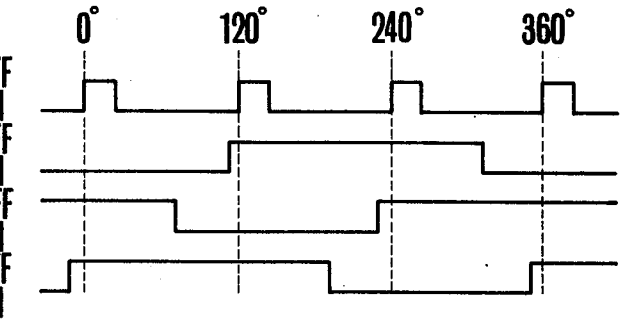
FIG.8A
FIG.8B
FIG.8C
FIG.8D

IGNITION SYSTEMS OF INTERNAL COMBUSTION ENGINES

BACKGROUND OF THE INVENTION

This invention relates to an ignition system of an internal combustion engine, and more particularly to a battery type ignition system.

Depending upon the state of an ignition transformer at the time of ignition, the ignition system of the type referred to above is generally classified into current interruption type and voltage impression type, and the former type is now used extensively.

In one construction of the ignition system of this type, the primary winding of an ignition transformer and the contact of an interrupter are connected in series with a source of direct current, and an ignition plug is connected across the secondary winding of the ignition transformer. Upon closure of the interrupter contact, primary current that increases gradually at a rate determined by the inductance and the DC resistance component of the primary winding flows therethrough to store electromagnetic energy in the ignition transformer. When the interrupter contact is opened the primary current is interrupted with the result that the magnetic flux in the core of the ignition transformer decreases rapidly due to the rapid decrease in the primary current. Due to electromagnetic induction caused by this rapid variation in the flux, a high voltage is induced in the secondary winding which strikes a spark across the ignition plug. While the construction described above is relatively simple and inexpensive, it has the following disadvantages. More particularly, since in the current interruption type it is necessary to store a large electromagnetic energy in the transformer for generating high voltage, it is usual to use an open core type ignition transformer. Although this type of the ignition transformer has a large reluctance and is difficult to saturate magnetically so that it is suitable to store a large magnetic energy, it is difficult to design it to have a large effective permeability so that it is necessary to increase the number of turns of the winding in order to obtain a required inductance. As a consequence, not only the loss is large and the efficiency is low but also the secondary distributed capacity, the secondary DC resistance component and the leakage reactance are increased. This results in the increase of the output impedance and in the poor build up characteristic of the secondary voltage. Furthermore, the open core type ignition transformer can not produce high secondary voltage when the leakage resistance decreases due to deposition of carbon on the ignition plug.

One example of the voltage impression type ignition system is disclosed in U.S. Pat. No. 3,318,295 having a circuit construction as shown in FIG. 1 of the accompanying drawing. As shown, a DC source, for example a battery 11, is connected to a DC-DC converter 12 which boosts DC voltage. A primary winding 15*a* of an ignition transformer 15 and a semiconductor controlled rectifier or thyristor 16 are connected in series and they are connected in series with the converter 12. A capacitor 14 is connected in parallel with series connection of the primary winding 15*a* and the thyristor 16. The secondary winding 15*b* of the ignition transformer 15 is connected across an ignition plug 17. The gate electrode of the thyristor 16 is connected to a trigger circuit 18 which generates a trigger pulse for operating the plug 17 at a desired ignition angle.

In the operation of the circuit shown in FIG. 1, the voltage of the DC source is boosted by the DC-DC converter 12 for storing an electrostatic energy in capacitor 14. When a trigger pulse is applied across the gate and cathode electrodes of the thyristor 16 from the trigger circuit 18, the thyristor 16 is rendered conductive to discharge the energy stored in the capacitor through the primary winding 15*a* of the ignition transformer 15. In other words, the voltage across the capacitor 14 is impressed across the primary winding 15*a*. Consequently, high secondary voltage is induced across the secondary winding 15*b* which is applied across the ignition plug 17 thereby igniting a fuel-air mixture.

With this construction, the ignition transformer 15 is not required to store electromagnetic energy as in the current interruption type so that it is possible to use a closed core type ignition transformer. The closed core type ignition transformer has a small reluctance and loss as well as a high efficiency so that it is possible to make it smaller than the open core type ignition transformer. Moreover, since the output impedance is low it is possible to produce high secondary voltage. Further, since its secondary distributed capacitance is small, its secondary voltage build up characteristic is greatly improved. For this reason, even though the ignition plug is contaminated more or less by the deposited carbon, it is possible to produce sufficiently high secondary voltage. In this manner, the closed core type ignition transformer can eliminate most of the defects of the open core type ignition transformer, but it is impossible to obtain a high voltage without boosting the voltage of a DC source, such as a battery. Thus, this type of ignition system requires to use a DC-DC converter thus increasing the number of component elements and the cost of the ignition system.

SUMMARY OF THE INVENTION

Accordingly, it is an object of this invention to provide an improved ignition system for an internal combustion engine having an extremely simple construction, and small size and is inexpensive.

Another object of this invention is to provide an improved ignition system for an internal combustion engine, which includes a novel distributor and a control circuit therefor capable of accurately operating over a long period without wear.

According to one aspect of this invention there is provided an ignition system of an internal combustion engine, comprising a source of direct current, a reactor, an ignition transformer including a primary winding connected in series with the reactor across the DC source and a secondary winding connected across a spark plug of the internal combustion engine, and an interrupter connected in parallel with the primary winding.

According to another aspect of this invention there is provided an ignition system of an internal combustion engine comprising a source of direct current, a reactor circuit, an ignition transformer circuit, a gate circuit connected in parallel with the ignition transformer circuit, the ignition transformer circuit including at least one ignition transformer having a primary winding and a secondary winding, the primary winding being connected across the DC source through the reactor circuit, the secondary winding being connected across a spark plug of the internal combustion engine, and means for ON/OFF - controlling the gate circuit at a predetermined period, the gate circuit when closed short-circuiting the primary winding of the ignition transformer and storing electromagnetic energy in the reactor circuit, and when opened supplying the stored electromagnetic energy and current from the DC source to the primary winding thus inducing high voltage in the secondary winding for operating the spark plug.

BRIEF DESCRIPTION OF THE DRAWINGS

In the accompanying drawings:

FIGS. 6*a*–6*e* shows waveforms of various portions shown in FIG. 4 useful to explain the operation of the embodiment shown in FIG. 4;

FIGS. 8A through 8D are waveforms useful to explain the operation of the modification shown in FIG. 7.

DESCRIPTION OF THE PREFERRED EMBODIMENTS

Figure 1:
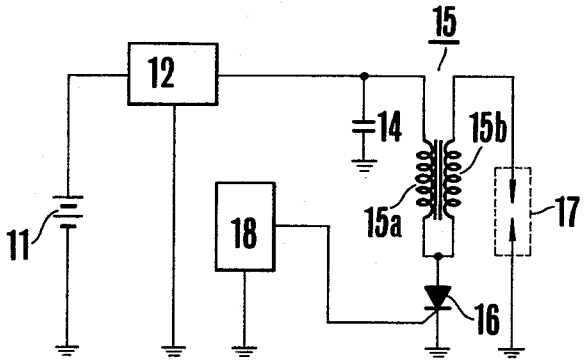
FIG.1 PRIOR ART
FIG. 1 is a connection diagram showing one example of a prior art ignition system for an internal combustion engine.
Figure 2:
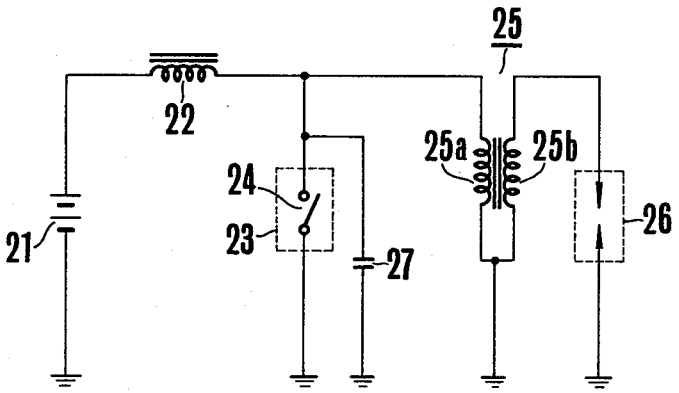
FIG. 2 is a connection diagram showing the basic construction of the ignition system embodying the invention.

In a preferred embodiment of this invention shown in FIG. 2, a reactor 22 having a suitable DC resistance component and the contact 24 of an interrupter 23 are connected in series across a DC source 21 such as a storage battery. As is well known in the art, the interrupter 23 is constructed to be opened and closed at a suitable timing in accordance with the rotation of the crankshaft of an internal combustion engine, not shown. The reactor 22 has a relatively large inductance so that it can store a sufficiently large electromagnetic energy. In series with said reactor 22 across said DC source 21 or across the interrupter contact 24 is connected the primary winding 25*a* of an ignition transformer 25 whose secondary winding 25*b* is connected across an ignition plug 26. Furthermore, an electric arc suppressing capacitor 27 is connected in parallel with the interrupter contact 24.

The ignition system shown in FIG. 2 operates as follows: When the contact 24 of the interrupter 23 is closed, the current from the DC source 21 flows through the reactor 22 and the contact 24. Since the impedance of the primary winding 25*a* is substantially higher than that of the circuit through contact 24, substantially no current flows through the primary winding 25*a*. The current flowing through the interrupter 23 varies as shown by the solid line shown in FIG. 3, and the current is limited to suitable value by the DC resistance component of the reactor 22. When the contact 24 of the interrupter is opened, then the current that has been flown through the contact 24 is switched to flow through the primary winding 25*a*. The current flowing through the primary winding 25*a* is also shown by the solid line in FIG. 3. The current variation at this time is extremely steep. Such rapid switching of the current path results in a rapid variation in the magnetic flux of the ignition transformer 25 thus causing the primary current to jump. As a consequence, high secondary voltage corresponding to the turn ratio of the primary and secondary windings is induced in the secondary winding 25*b* which is applied across the ignition plug to strike an electric arc. Thus, at an instant when the interrupter contact 24 is opened the energy stored in the reactor 22 while the interrupter contact 24 is closed is applied to the primary winding 25*a* of the ignition transformer 25 thereby producing high secondary voltage.

Figure 3:
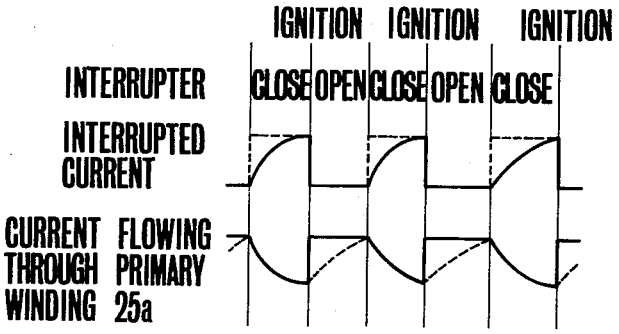
FIG. 3 shows waveforms of various parts useful to explain the operation of the system shown in FIG. 2.

Dotted lines shown in FIG. 3 indicate current waveforms where only a resistance element is used instead of reactor 22 of this invention. As shown, when the interrupter contact 24 is opened the primary current does not vary rapidly so that it is impossible to produce sufficiently high secondary voltage. This is because a simple resistance element can not store electromagnetic energy.

In this manner, in the ignition system of this invention the switching of the current is done by the opening of the interrupter contact 24, but the novel system is different from the prior art current interruption type ignition system wherein the primary current is perfectly interrupted to induce high secondary voltage. According to this invention, the electromagnetic energy stored in the reactor 22 is applied to the primary winding 25*a* of the ignition transformer when the interrupter contact 24 is opened which is quite different from the prior art voltage impression type in which the electrostatic energy is applied to the primary winding. However, since the ignition system of this invention is also of the voltage impression type, it is possible to increase the effective permeability thereby enabling to use a closed core type ignition transformer. Accordingly it is possible to design an ignition transformer having a low loss and a high efficiency. Further, as it is possible to miniaturize the ignition transformer 25 relative to that of the conventional current interruption type, which is effective to miniaturize the entire ignition system. Further, as it is possible to reduce the output impedance, it is not only possible to increase the secondary voltage but also to improve the build up characteristic of the secondary voltage. Accordingly, even when carbon deposits on the ignition plug so that the leakage resistance decreases after an operation for a long time or due to improper operation, it is possible to produce sufficiently high secondary voltage.

It should be understood that the invention is by no means limited to the embodiment described above. For example, while in the foregoing embodiment a reactor having a DC resistance component was used, it is also possible to connect a resistor in series with the reactor for adjusting the current value to a desired value. Furthermore, it is possible to substitute a semiconductor switch for a mechanical interrupter.

This invention is particularly advantageous when used for a multicylinder type internal combustion engine. Namely, in this type electromagnetic energy is accumulated by a single reactor, but not accumulated by the respective transformers, so that the size of the transformer can be small and the construction as a whole can be made compact.

Where an ignition system is applied to a multicylinder type internal combustion engine it is usual to connect a distributor with a ignition transformer circuit and to drive the distributor at a speed corresponding to the number of the ignition transformers. However, the distributor is also a type of interrupter so that there is a defect of wear of the contacts. For this reason, after a long time, the degree of wear of the contacts of the interrupter and the distributor becomes different or the degree of looseness between the interrupter cam and its driving shaft and that between the rotor of the distributor and its driving shaft becomes different with the result that the optimum ignition timing becomes impossible. Moreover, since large current flows through the interrupter and since the number of interruptions increases with the number of the ignition transformers, the wear of the contact increases. For this reason, when an ignition system designed for a single cylinder internal combustion engine is applied to a multicylinder internal combustion engine, there is a problem caused by the durability.

Figure 4:
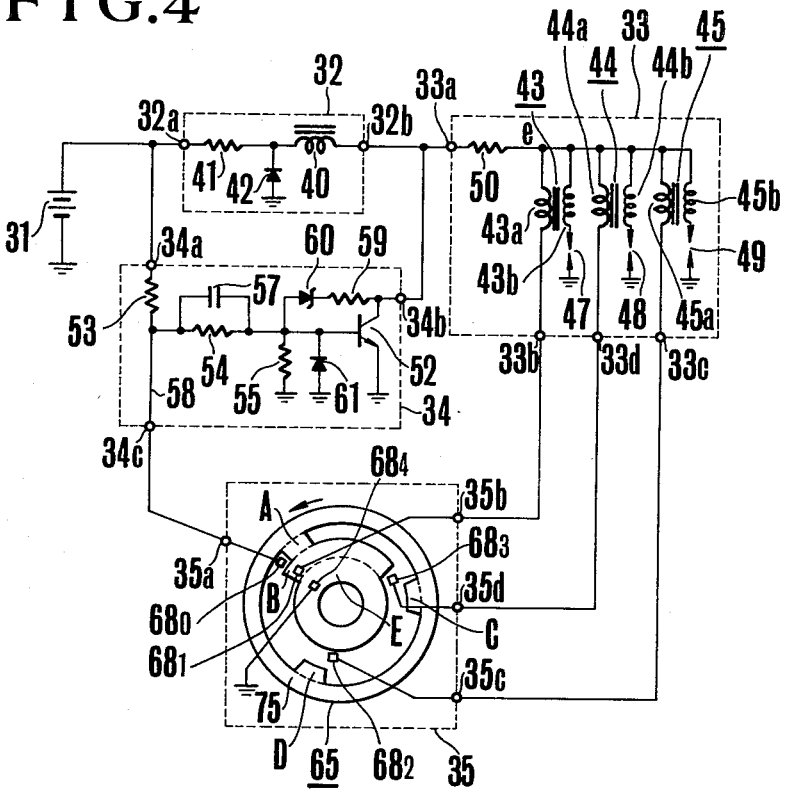
FIG. 4 is a detailed connection diagram of one embodiment of the ignition system for an internal combustion engine embodying the invention.

FIG. 4 shows a detailed circuit diagram of one embodiment of this invention which is improved to increase the durability of the ignition system which is designed for use in a three cylinder internal combustion engine.

The ignition system shown in FIG. 4 comprises a source of DC 31, a reactor circuit 34, and a distributor 35 provided with a timing signal detector. The positive pole or anode of the DC source 31 is connected to the input terminal 32*a* of the reactor circuit 32 while the output terminal 32*b* thereof is connected to the input terminal 33*a* of the ignition transformer circuit 33. There is provided an interrupter circuit 34 including terminals 34*a*, 34*b* and 34*c* of which terminal 34*a* is connected to the juncture between the DC source 31 and the reactor circuit 32, that is the input terminal 32*a* thereof. The terminal 34*b* is connected to the juncture between the reactor circuit 32 and the ignition transformer circuit 33, that is the input terminal 33*a* thereof while the terminal 34*c* is connected to the timing signal detecting terminal 35*a* of the distributor 35. The distributor 35 is provided with distribution terminals 35*b*, 35*c* and 35*d* in addition to the terminal 35*a* and the distribution terminals are connected to the terminals 33*b*, 33*c* and 33*d* of the ignition transformer circuit 33.

The detail of the construction of respective elements will now be described. More particularly, the reactor circuit 32 comprises a reactor 40 having a relatively large inductance, a resistor 41 for compensating for the DC resistance component of the reactor 40, and a diode 42 for adsorbing the back electromotive force of the reactor.

The ignition transformer circuit 33 comprises three ignition transformers 43, 44 and 45 including primary windings 43*a*, 44*a* and 45*a* and secondary windings 43*b*, 44*b* and 45*b* respectively, and ignition plugs 47, 48 and 49. One terminal of respective primary windings are commonly connected to one terminal of a resistor 50 having its other terminal connected to the input terminal 33*a*. The other ends of the primary transformers are connected to terminals 35*b*, 35*c* and 35*d* of the distributor via terminals 33*b*, 33*c* and 33*d* respectively, thus forming a so-called low voltage distribution system.

As will be described later in more detail the resistor 50 serves to control the current thus rapidly decreasing the primary current of the ignition transformer for the first cylinder during the interval between the ignitions of the first and second cylinders. For this reason, the resistor 50 is necessary for high speed multicylinder type internal combustion engine.

The interrupter circuit 34 comprises a gate circuit made up of the collector and the emitter electrodes of a transistor 52, a control circuit including the base biasing resistors 53, 54 and 55 of the transistor 52, a speed up capacitor 57 and a signal line 58 connected to the timing signal detection terminal 35*a* of the distributor 35 via terminal 34*c*, a protective resistor 59 for the transistor 52, an avalanche diode 60 and a diode 61.

Figure 5:
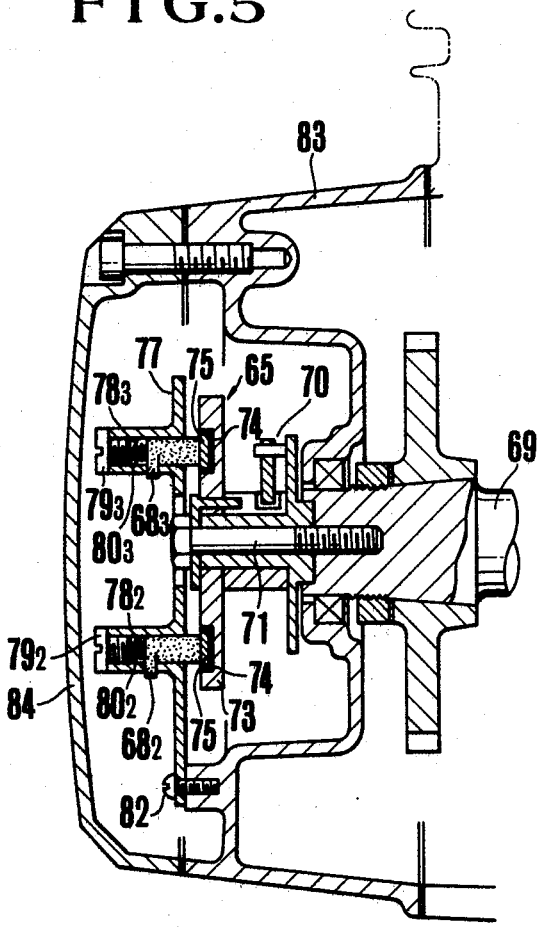
FIG. 5 is a sectional view of a portion of an internal combustion engine showing the manner of mounting the slip ring and stationary brushes.

The distributor 35 comprises a slip ring 65 and stationary pieces or brushes $68_0$, $68_1$, $68_2$, $68_3$ and $68_4$. As shown in FIG. 5, the slip ring 65 is mounted on a crankshaft 69 of the engine to rotate therewith and secured thereto by means of a bolt 71 through a governer 70 so as to vary its angle of advance. The slip ring 65 includes a grounded electrode 75 embedded in the surface of a circular disc shaped supporting member 73 through an insulator 74, the detail of the grounded electrode 75 being shown in FIG. 4. More particularly, the grounded electrode 75 comprises regions A,B,C and D contacting the brushes $68_0$, $68_1$, $68_2$, $68_3$ and $68_4$ corresponding to the angles of rotation of 0°, 120° and 240° respectively of the crankshaft 69, the regions A, C and D being arranged in the circumferential direction at an equal spacing of 120°. The electrode 75 is provided with region B contiguous to region A and adapted to sequentially contact brushes $68_1$, $68_2$ and $68_3$ with a predetermined timing. Although region B extends as an arc near region C but is not continuous thereto. Further, the electrode 75 is provided with region E contiguous to region B, the region E taking the form of an annular ring normally in contact with the stationary brush $68_4$. The brush $68_0$ is used as a timing brush for detecting the timing signal and connected to the timing signal detecting terminal 35*a*. The brushes $68_1$, $68_2$ and $68_3$ are distribution brushes and are spaced each other by 120° and connected to the distribution terminals 35*b*, 35*c* and 35*d*. The brush $68_4$ is a common grounding brush and by connecting the brushes $68_0$, $68_1$, $68_2$ and $68_3$ to the grounded electrode 75 the signal line 58 connected therewith and primary windings 43*a*, 44*a* and 45*a* are grounded. Where a plurality of grounding brushes $68_4$ are provided even when one of them lifts due to vibration it is possible to positively maintain the grounding connection. These brushes $68_0$, $68_1$, $68_2$, $68_3$ and $68_4$ are received in mounting openings $78_0$ through $78_4$ (in FIG. 5 only openings $78_2$ and $78_3$ are shown) formed in the supporting plate 77 and normally urged toward slip ring 65 by springs $80_0$ through $80_4$ (only $780_2$ and $80_3$ are shown) supported by screws $79_0$ through $78_4$ (only $79_2$ and $79_3$ are shown) for closing the opening $78_0$ through $78_4$ respectively. The supporting plate 77 for the short-circuiting pieces is secured to the crankcase 83 by screws 82. Slip ring 65 and brushes $68_0$, $68_1$, $68_2$, $68_3$ and $68_4$ can readily be repaired and exchanged by removing the crankcase cover 84.

The operation of the ignition system will now be described with reference to the timing chart shown in FIGS. 6A through 6E. It is assumed that the grounded state is termed ON, and the nongrounded state OFF. In FIG. 6A, until the rotation of the crankshaft reaches 0°, the timing brush $68_0$ is OFF. In other words, since the signal line 58 is opened, DC current flows to transistor 52 of the interruption circuit 34 from DC source 31 via resistors 53 and 54 thus turning on transistor 52. For this reason, the current from the source 31, that is the output from the reactor circuit 32 flows to the ground through the reactor circuit 32 and the collector-emitter path of the transistor 52. Accordingly, current does not flow through any one of the primary windings 43*a*, 44*a* and 45*a* of the ignition transformers 43, 44 and 45 irrespective of the ON and OFF states of the distribution brushes $68_1$, $68_2$ and $68_3$.

When the crankshaft 69 rotates to 0° position shown in FIG. 6A, the region A of the grounded electrode shown in FIG. 4 comes to contact the timing brush $68_0$ thus causing it ON as shown in FIG. 6B, thus grounding the signal line 58. Accordingly, the voltage of the base electrode of transistor becomes cut off potential thus quickly turning OFF transistor 52. Then, the current that has been flowing to the ground through reactor circuit and transistor 52 will be interrupted thereby causing voltage boosting due to the self induction of the reactor 40 of the reactor circuit 32.

When the crankshaft 69 reaches the 0° position as above described the distribution brush $68_1$ has already been ON (FIG. 6B) by contact with region B of the grounded electrode 75 prior to the timing brush $68_0$. Accordingly, the current, whose circuit has been interrupted as above described, now tends to flow through the primary winding 43*a* of the ignition transformer 33, but the current can not flow immediately due to the time constant determined by the inductance and the DC resistance component of the primary winding 43*a* whereby voltage boosting is created like reactor 40. The voltage across reactor 40 is immediately applied across the primary winding 43*a* so that the primary voltage (the potential at point *e*) is increased due to the superposition of the two voltage with the result that the variation of the primary current produced thereby becomes extremely large. As a consequence, an extremely high voltage is induced in the secondary winding 43*b* of the ignition transformer 43 to strike a spark across the ignition plug 47. Thus, the electromagnetic energy stored in the reactor 40 is supplied to the primary winding 43*a* to induce a high secondary voltage.

As the crankshaft 69 rotates further so that the timing brush $68_0$ disengages from region A signal line 58 becomes OFF so that the base current of transistor 52 flows again through resistors 53 and 54, and the current from the reactor circuit 32 flows again to the ground through transistor 52. At this time, the current flowing through the primary winding 43*a* tends to decrease rapidly but since there is no voltage applied from the reactor 40, high voltage will not be induced on the secondary side.

As the crankshaft 69 rotates further and when the distribution brush $68_2$ comes to engage region B, the distribution brush $68_1$ is still on its ON state so that both distribution brushes $68_1$ and $68_2$ are maintained on the ON state for a while. As the crankshaft 69 rotates further, only the distribution brush $68_1$ becomes OFF by being disengaged from region B while the distribution brush $68_2$ remains ON. This condition is shown by FIGS. 6B and 6C. Thereafter, when the crankshaft 69 reaches the 120° position, the timing brush $68_0$ contacts again the region C of the grounded electrode 75 and becomes ON. In the same manner as above described the current flowing through the primary winding 44*a* of the ignition transformer 44 varies greatly thus inducing a high voltage in the secondary winding 44*b*.

In this manner, ignition transformers 43, 44 and 45 are sequentially energized to sequentially operate the spark plugs 47, 48 and 49.

Where the resistor 50 is not provided for the ignition transformer circuit 33, the following disadvantages occur. More particularly, when the distribution brush $68_1$, for example, becomes OFF, the current through the primary winding 43*a* of the ignition transformer 43 does not reduce to zero immediately but reduces gradually with the time constant determined by the inductance and the DC resistance component of the primary winding 43*a*. Due to some reasons, this current may have a large value enough to induce a high voltage in the secondary winding 43*b* thus resulting in a spark at a unwanted time. The resistor 50 is effective to rapidly reduce the primary current and prevents sparking at a unwanted time. However, the resistor 50 may be omitted if the primary windings were wound to have a large DC resistance with thin wires.

In the foregoing embodiment, adjacent distribution brushes, for example $68_1$ and $68_2$, are arranged to overlap each other for certain degrees during the ON period, as shown in FIG. 4. This arrangement is extremely advantageous to improve the spark characteristic for the following reasons. Thus, referring again to FIG. 4, assume now that the distribution brush 68 becomes OFF so that due to the inductance of the primary winding 43*a* of the ignition transformer 43 current tends to continuously flow through the primary winding. Although this current is caused to quickly reduce by the resistor 50 as above described, there is a limit.

When ON states of the distribution brushes $68_1$ and $68_2$ are overlapped to some extent, said current flows through the primary winding 44*a* of the ignition transformer 44 from the primary winding 43*a* of the ignition transformer 43 via the distribution brush $68_1$ and the ground. This phenomenon is shown by the negative voltage pulse *f* occurring in the waveform at point *e* shown in FIG. 6E. During the pulse *f*, current flows from the ground to point *e* since the potential of point *e* is lower than the ground potential. This current magnetizes the core of the ignition transformer 44 in the opposite direction and this state of magnetization is preserved by the hysteresis of the core. Thereafter, the timing brush $68_2$ becomes ON and the transistor 52 of the interruption circuit 34 turns OFF. Then current flows through the primary winding 44*a* of the ignition transformer 34 via the reactor circuit 32. However since the core of the ignition transformer 44 is magnetized in the opposite direction, the sum of the magnetic flux variation until the magnetization reaches saturation in the forward direction is larger than the case where ON states of the distribution brushes do not overlap. For this reason, the spark characteristic can be improved greatly where a closed core type ignition transformer is used.

As can be noted from the foregoing description in the foregoing embodiment, an interruption circuit comprising a contactless gate circuit and a control circuit therefore is substituted for a mechanical interrupter and furthermore a timing signal detector is incorporated into the distributor for distributing the ignition voltage among a plurality of cylinders so that the timing signal detector and the contact portions of the distributor always wear by substantially the same extent. Moreover, as there is no intermediate between them and since they have constantly fixed relationship, there is no fear of varying the timing after a long use thereby assuring most suitable timing of the ignition. Further, only a small current required for controlling transistor 52 flows through the timing brush $68_0$ and the grounded electrode 75 of the slip ring 65. Although a relatively large current flows through the distribution brush 68 and the grounded electrode 75 of the slip ring 65, as these members engage each other prior to the flow of such large current through the primary winding 43*a* of the ignition transformer 43 and as they still maintain the engagement after the termination of the current, these members do not directly ON/OFF-control the large current. Thus, between the brushes $68_0$, $68_1$, $68_2$, $68_3$ and $68_4$ and the grounded electrode 75 of the slip ring only a small current is ON/OFF-controlled and the large current is not ON/OFF-controlled consequently, the wear of the contact is small even after operation for long period thereby increasing the useful time. Further, by inserting resistor 50 between the reactor circuit 33 and the ignition transformer circuit 33 it is possible to prevent an ignition at an unwanted time thus preventing damage of the internal combustion engine. Thus, the invention provides a reliable and durable ignition system for high speed multicylinder internal combustion engines.

Figure 7:
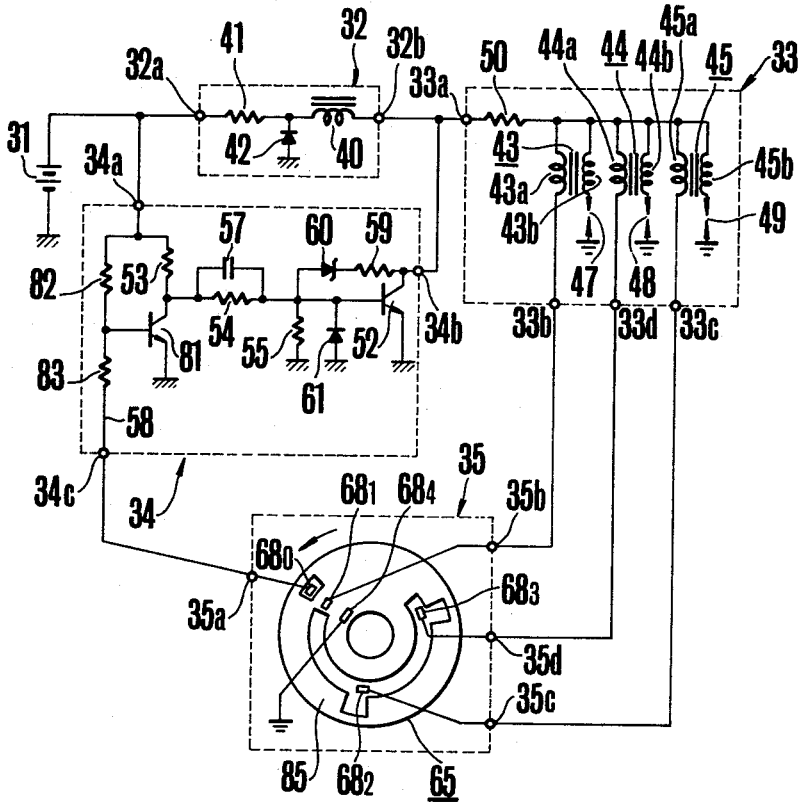
FIG. 7 is a connection diagram showing a modified embodiment of this invention.

FIG. 7 shows a modified embodiment of this invention in which elements corresponding to those shown in FIG. 4 are designated by the same reference numerals. The operations of various element are shown by the waveforms shown in FIGS. 8A through 8D. The modified embodiment shown in FIG. 7 is different from that shown in FIG. 4 in that the timing of transistor 52 is reversed by adding a NPN transistor 81, and resistors 82 and 83 to the interruption circuit 34, and that the patterns A, C and D contacting the timing brush $68_0$ of the grounded electrode 85 of the slip ring 65 are reversed accordingly. Consequently, transistor 81 is turned ON when the timing brush $68_0$ is not engaging the grounded electrode 85 thereby rendering OFF transistor 52 whereas when the timing brush $68_0$ engages the grounded electrode 85, the transistor 52 is turned ON.

The operation of this modification can readily be understood from FIGS. 8A through 8D by referring to the foregoing description regarding the waveforms shown in FIGS. 6A through 6E.

According to this embodiment, ignition is caused when the timing brush $68_0$ is turned OFF. This gives advantage that there is less chattering compared with the embodiment in FIG. 4.

Figure 9:
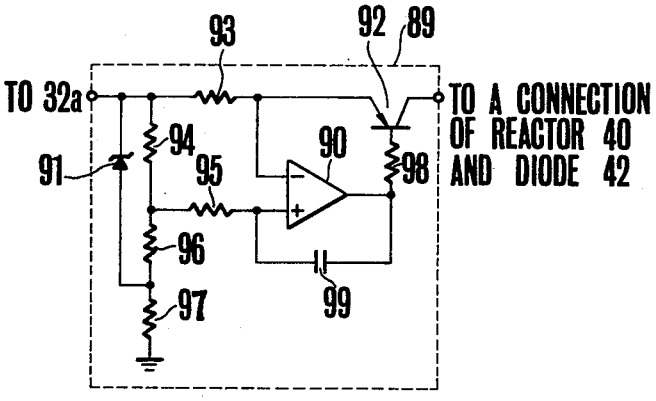
FIG. 9 is a connection diagram showing one example of a constant current circuit to be substituted for the resistor of the ignition system shown in FIG. 4.

In the foregoing embodiment, it is possible to substitute a constant current circuit for the resistor 41 in the reactor circuit 32. In this case there is an advantage that the spark characteristic does not degrade at high speed operation of the engine. Thus, during the high speed operation, the load impedance tends to increase thereby decreasing current. Since the constant current circuit prevents such current decrease so that degradation of the spark characteristic can be prevented. Where a constant current circuit 89 as shown in FIG. 9 is used, it is possible to decrease the load on the DC source 31 and to limit heating of the circuit elements. The constant current circuit shown in FIG. 9 comprises an inverting amplifier 90 acting as an operational amplifier, an avalanche diode 91, a PNP transistor 92, resistors 93 through 98 and a capacitor 99 which are connected as shown. With this connection when the current flowing through the collector-emitter path of transistor 92 decreases, the base potential of transistor 92 increases thereby increasing the collector-emitter current.

While the invention has been shown and described in terms of certain preferred embodiments, it should be understood that many changes and modifications will be obvious to one skilled in the art without departing from the true spirit and scope of the invention as defined in the appended claims.

What is claimed is:

1. An ignition system of an internal combustion engine, comprising a source of direct current, a reactor, and a primary winding of an ignition transformer connected in series in a direct current conductive circuit, a secondary winding on said transformer for supplying a spark plug of said internal combustion engine, and a circuit including an interrupter connected in parallel with said primary winding.

2. An ignition system of an internal combustion engine comprising a source of direct current, a reactor circuit, an ignition transformer circuit, and a gate circuit said ignition transformer circuit including at least one ignition transformer having a primary winding and a secondary winding, said primary winding being connected in series direct current conductive circuit across said DC source through said reactor circuit, said secondary winding being connected across a spark plug of said internal combustion engine, and means for ON/-OFF-controlling said gate circuit at a predetermined period, said gate circuit being connected in parallel with said primary winding and when closed short-circuiting said primary winding of said ignition transformer and storing electromagnetic energy in said reactor circuit, and when opened supplying said stored electromagnetic energy in said reactor circuit, and when opened supplying said stored electromagnetic energy and current from said DC source to said primary winding thus inducing high voltage in said secondary winding for operating said spark plug.

3. The ignition system according to claim 2 wherein said reactor circuit comprises a resistor and a reactor which are connected in series with one pole of said DC source and a diode connected between the juncture of said resistor and said reactor and the other pole of said DC source.

4. The ignition system according to claim 2 which further comprises an interruption circuit connected in parallel with said ignition transformer circuit and includes a transistor having collector and emitter electrodes comprising said gate circuit and a base electrode comprising a part of said ON/OFF-controlling means connected to one pole of said DC source.

5. An ignition system of an internal combustion engine comprising a source of direct current, a reactor circit, an ignition transformer circuit, and a gate circuit connected in parallel with said ignition transformer circuit, said ignition transformer circuit comprising a plurality of ignition transformers each having a primary winding and a secondary winding connected across one spark plug of said engine, and a secondary winding, each said primary winding being connected across said DC source through said reactor circuit, means for ON/-OFF-controlling said gate circuit at a predetermined period, said gate circuit when closed short-circuiting said primary winding of said ignition transformer and storing electromagnetic energy in said reactor circuit, and when opened supplying said stored electromagnetic energy and current from said DC source to one of said primary windings thus inducing high voltage in a respective one of said secondary windings for operating each said spark plug, each said primary winding being energized sequentially by a circuit having a distributor including a slip ring rotated by said engine and having an annular grounded electrode provided with a plurality of regions spaced a predetermined angle corresponding to the number of said ignition transformers, a timing brush connected to said ON/OFF controlling means, a plurality of distribution brushes respectively connected to the primary windings of said ignition transformers, and a common brush connected to the ground.

6. The ignition system according to claim 4 wherein said interruption circuit further comprises a second transistor for reversing the conduction period of said first mentioned transistor.

7. The ignition system according to claim 2 wherein said reactor circuit comprises a constant current circuit and a reactor connected in series therewith.

8. The ignition system according to claim 5 wherein the region of the grounded electrode is made to cover the spacing between distribution brushes adjacent to each other so as to let at least two distribution brushes be in the state of being grounded at the same time through said grounded electrode.

9. The ignition system according to claim 5 wherein said ignition transformer circuit further includes current control means which is provided between the ignition transformer and a juncture made by the reactor circuit and the ignition transformer circuit.

* * * * *